US007189916B2

(12) United States Patent
Kinman

(10) Patent No.: US 7,189,916 B2
(45) **Date of Patent: *Mar. 13, 2007**

(54) NOISE SENSING BOBBIN-COIL ASSEMBLY FOR AMPLIFIED STRINGED MUSICAL INSTRUMENT PICKUPS

(76) Inventor: Christopher Ian Kinman, Unit 3, 28 Baldock Street, Moorooka, Brisbane, QLD 4105 (AU)

( * ) Notice: Subject to any disclaimer, the term of this patent is extended or adjusted under 35 U.S.C. 154(b) by 0 days.

This patent is subject to a terminal disclaimer.

(21) Appl. No.: 11/332,108

(22) Filed: Jan. 16, 2006

(65) Prior Publication Data

US 2006/0112816 A1 Jun. 1, 2006

Related U.S. Application Data

(63) Continuation of application No. 10/612,181, filed on Jun. 30, 2003, now Pat. No. 7,022,909, which is a continuation of application No. 09/909,473, filed on Jul. 19, 2001, now abandoned, which is a continuation-in-part of application No. PCT/AU00/00027, filed on Jan. 19, 2000.

(30) Foreign Application Priority Data

Jan. 19, 1999 (AU) ..... PP8242
Mar. 5, 1999 (AU) ..... PP9052

(51) Int. Cl.
*G10H 3/18* (2006.01)

(52) U.S. Cl. ..... 84/726

(58) Field of Classification Search ..... 84/725–728
See application file for complete search history.

(56) References Cited

U.S. PATENT DOCUMENTS

| | | | |
|---|---|---|---|
| 2,896,491 | A | 7/1959 | Lover |
| 3,588,311 | A | 6/1971 | Zoller |
| 3,711,619 | A | 1/1973 | Jones et al. |
| 3,916,751 | A | 11/1975 | Stich |
| 3,963,975 | A | 6/1976 | Gauper, Jr. et al. |
| 3,969,771 | A | 7/1976 | Suzuki et al. |
| 4,372,186 | A | 2/1983 | Aaroe |
| 4,442,749 | A | 4/1984 | DiMarzio et al. |
| 4,501,185 | A | 2/1985 | Blucher |
| 4,524,667 | A | 6/1985 | Duncan |
| 4,809,578 | A | 3/1989 | Lace, Jr. |
| 5,111,728 | A | 5/1992 | Blucher et al. |
| 5,168,117 | A | 12/1992 | Anderson |
| 5,221,805 | A | 6/1993 | Lace |
| 5,354,949 | A | 10/1994 | Zwaan |
| 5,399,802 | A | 3/1995 | Blucher |
| 5,464,948 | A | 11/1995 | Lace |
| 5,530,199 | A | 6/1996 | Blucher |

(Continued)

FOREIGN PATENT DOCUMENTS

| | | |
|---|---|---|
| AU | 711540 | 9/1997 |

(Continued)

*Primary Examiner*—Jeffrey W Donels
(74) *Attorney, Agent, or Firm*—Cantor Colburn LLP

(57) ABSTRACT

A noise sensing bobbin-coil assembly for use in conjunction with a musical instrument pickup is disclosed. In particular, the bobbin of the bobbin-coil assembly is adapted to resist induced eddy currents thereby allowing a fewer number of coils to be used which in turn reduces undesirable interaction with the musical instrument pickup.

28 Claims, 9 Drawing Sheets

U.S. PATENT DOCUMENTS

| | | | |
|---|---|---|---|
| 5,569,872 | A | 10/1996 | Gimpel |
| 5,668,520 | A | 9/1997 | Kinman |
| 5,789,691 | A | 8/1998 | Stitch |
| 5,811,710 | A | 9/1998 | Blucher et al. |
| 5,834,999 | A | 11/1998 | Kinman |
| 5,980,998 | A | 11/1999 | Blucher et al. |
| 6,103,966 | A | 8/2000 | Kinman |
| 6,111,185 | A | 8/2000 | Lace |

FOREIGN PATENT DOCUMENTS

| | | |
|---|---|---|
| AU | 20818/00 | 7/2000 |
| GB | 2311160 | 9/1997 |
| WO | WO-99/39332 | 8/1999 |

FIG. 7b
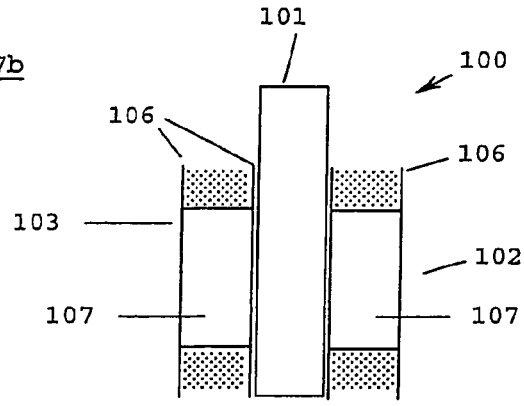
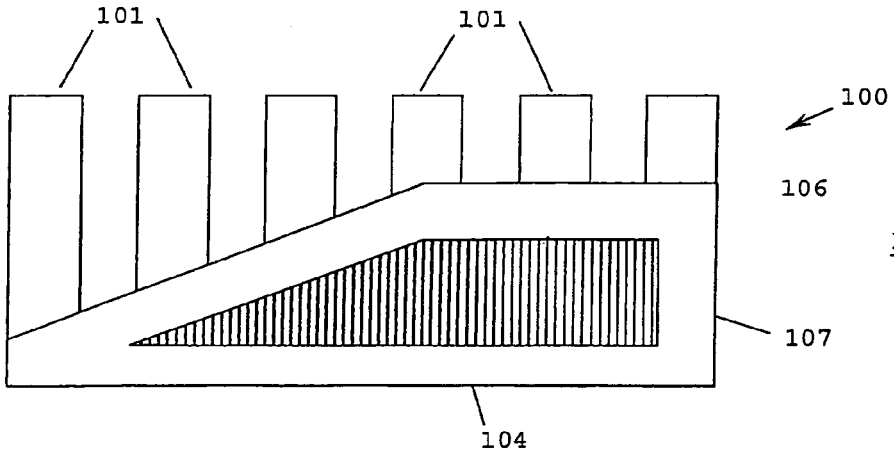
FIG. 7a
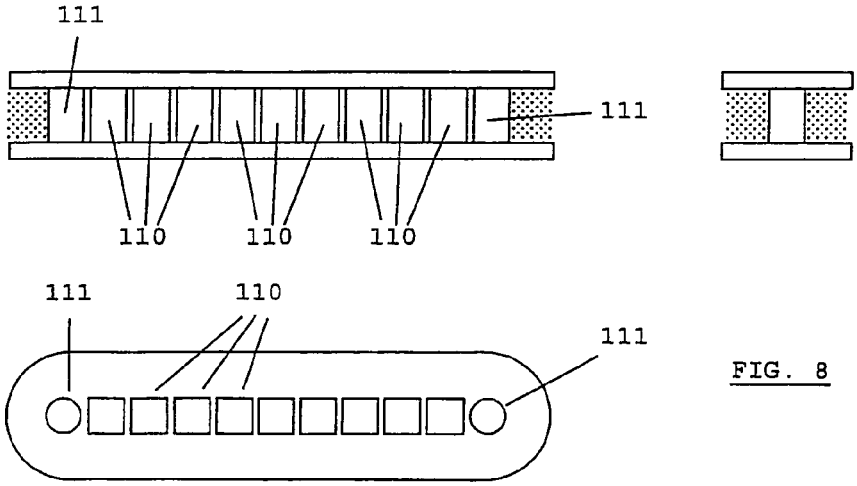
FIG. 8

NOISE SENSING BOBBIN-COIL ASSEMBLY FOR AMPLIFIED STRINGED MUSICAL INSTRUMENT PICKUPS

CROSS-REFERENCE TO RELATED APPLICATIONS

This application is a continuation of U.S. patent application Ser. No. 10/612,181 filed Jun. 30, 2003 now U.S. Pat. No. 7,022,909, which is a continuation of U.S. patent application Ser. No. 09/909,473, filed Jul. 19, 2001 now abandoned as a continuation-in-part of International Patent Application Number PCT/AU00/00027, filed Jan. 19, 2000 and claims priority from Australian Patent Application Numbers PP 9052, filed Mar. 5, 1999 and PP 8242, filed Jan. 19, 1999. The entire disclosure of each of the earlier applications is incorporated herein by reference.

FIELD OF THE INVENTION

This invention relates to noise cancelling coils for stringed musical instrument pickups.

BACKGROUND OF THE INVENTION

This invention has particular application to instrument pickups that utilize a single coil transducer to provide an electrical signal or "string-signal" output, corresponding to the vibrations of the strings of the instrument.

There are several types of single-coil pickups that are in widespread use in electric guitars because of the desirable individual responses they provide, causing a desired amplified sound. However these pickups in addition to providing the string-signal output also provide an unwanted output to be amplified which is induced from electrical noise external to the guitar. For example, "noise" can result from a small voltage of 50 Hz or 60 Hz induced from mains power. This noise can be most annoying to musicians and their audience.

The most popular single-coil guitar pickup in use is that standardly provided in the Fender® Stratocaster® (Fender Musical Instruments Corp., 1130 Columbia Street, Brea, Calif. USA). This pickup provides coveted response characteristics that yield great sensitivity and expression in response to the various ways the guitar strings are plucked, tapped, scraped and pinched with plectrums, fingernails, or any of a wide variety of other methods used by countless guitar players throughout the world.

There have been many attempts over the decades to cancel unwanted noise in pickups which provide the response of the Fender®™ Stratocaster®™ devices but previous methods have introduced their own set of problems and shortcomings. The valued subtle nuances of the Stratocaster®™ are often sacrificed when various noise cancelling techniques are employed.

Typically the problem of noise cancelling is tackled by providing a second coil which generates an equal and opposite noise voltage to cancel the noise voltage generated in the string-sensing pickup coil which provides the desired output to be amplified. Typically this further coil is disposed proximate to the string-sensing pickup coil.

Unfortunately this noise-sensing coil often chokes or constricts the subtle nuances of tone that are otherwise present in the string-sensing pickup coil because of excessive coil capacitance.

Another popular single coil pickup is the Gibson Guitar Company's P-90®™ pickup (Gibson Guitar Corp., 1818 Elm Hill Pike, Nashville, Tenn. USA). The P-90®™ pickup is slightly different to the Fender®™ single coil pickups in that it has a different magnetic system. The Fender®™ pickups utilize rod magnets beneath each string as the core of the coil whereas the P-90®™ pickup utilizes bar magnets disposed beneath the pickup coil with six adjustable steel screws as the core of the coil which conduct the magnetic field from the magnets to the strings. The coil of the P-90®™ has much more inductance than any Stratocaster®™ pickup. Consequently this device generates more noise voltage than the Fender®™ pickups.

It has been widely practiced that a side-by-side Gibson®™ style humbucking two coil pickup has one coil shorted or disconnected for the purpose of modifying the sound to resemble that of a Stratocaster®™ single coil pickup. The disabling of the second coil also disables the noise cancelling ability of the pickup since it has been temporarily transformed into a single coil pickup. By providing a further noise sensing coil of the present invention that is switched into circuit when the second coil is disconnected the facsimile Stratocaster®™ sound can also be noise free.

The Stratocaster®™ pickup typically has between 7,800 and 8,350 turns of 0.063 (42 gauge) wire to provide a DC resistance of between 5.6K ohms and 6.1K ohms and an inductance of 2.1 and 2.5 Henrys with a Q factor of approximately 2.8, whereas the P-90®™ pickup typically has in the order of 8,000 to 10,000 turns of 43 gauge wire to provide a DC resistance of about 8.3K ohms and an inductance of about 6.8 Henrys and a Q factor of 2.85.

Pickups having noise-sensing coils have been manufactured by me in accordance with my earlier Australian and United States Patents (AU 2081800; AU 711540; U.S. Pat. No. 5,668,520; U.S. Pat. No. 5,908,998; and U.S. Pat. No. 6,103,966). These pickups have emulated the sonic quality of a Stratocaster®™ pickup and utilize a noise-sensing coil with adequate noise-voltage/turns ratio achieved by forming the core of the noise cancelling coil of pins or rods made of magnetically permeable material, such as steel and by flanking each side of the noise sensing bobbin with unitary steel plates to boost the inductance.

While this arrangement has proved successful for the Stratocaster®™ style pickup it can be improved upon and it does not provide a noise cancelling solution the P-90®™ style pickups as the number of coil turns required to generate sufficient noise voltage is excessively high and the sonic degradation is correspondingly high due to the excessive capacitance of the coil.

This invention aims to provide improved noise sensing bobbin-coil assemblies for string musical instrument pickups.

SUMMARY OF THE INVENTION

With the foregoing in view, this invention in one aspect resides broadly in a noise sensing bobbin-coil assembly for use with stringed musical instrument pickups and including a core formed of magnetically permeable material which either minimizes eddy current losses or is configured to minimize eddy currents, and a coil of copper wire formed about said core for the purpose of generating a noise voltage in order to cancel a corresponding externally induced noise voltage in a stringed instrument pickup with which said noise sensing bobbin-coil assembly is to be associated to a desired extent.

Eddy current losses may be minimized by forming the core from steel laminations and suitably as a laminated steel bobbin assembly having integral laminated end flanges about which the coil is wound. Suitably the laminations are thin laminations stacked together and insulated from one another.

Alternatively the laminations of the core may comprise a relatively few rectangular section cores such as a plurality of square section pins interposed between round section side pins and forming the core about which the coil is wound. In this arrangement the pins are physically and electrically separated to reduce eddy currents.

Then again, the core or complete bobbin may be formed from a composite material that exhibits eddy current inhibiting properties, such as a suitable ferrite material. If desired the core may be molded with integral side flanges.

The core may extend between end flanges of magnetically permeable material. The end flanges may be steel plates or in the case of a sheet steel laminated core, they are a laminated flange formed integrally with the core laminations. In the case of a core formed from a ferrite material, the end flanges may be formed as a unitary form with the core. However if desired the end flanges of this invention may be formed separately from the core.

The noise sensing bobbin-coil assembly may be provided mounted in or on the body of a stringed musical instrument remote to the string sensing pickup coil of the instrument and connected in series or parallel with said string sensing pickup or pickups mounted on said same stringed musical instrument for the purpose of cancelling externally induced 50 Hz or 60 Hz hum or noise.

The bobbin-coil assembly may be incorporated into a "Lace" type pickup (Fender-Lace™, Fender Musical Instruments Corp., 1130 Columbia Street, Brea, Calif. USA), which is a pickup of the type with dual coils disposed adjacent to and axially perpendicular to the axis of the magnets.

According to a further aspect of the invention there is provided an electric guitar incorporating a noise sensing coil as previously described.

According to a further aspect of the present invention there is provided a guitar pickup arranged to emulate the desired sonic qualities of a Fender®™ single coil pickup, said pickup including a string sensing pickup coil formed about a magnet or magnets numbering one or more extending through dielectric plates and a noise sensing bobbin-coil assembly as defined above and underlying said string sensing pickup coil.

In one embodiment such a pickup has steel side-walls adjacent to the string sensing pickup coil.

In another aspect, this invention resides in a guitar pickup arranged to emulate the desired sonic qualities of a Gibson®™ P-90®™ pickup, the pickup including a string sensing pickup coil formed about a bobbin supporting a plurality of steel pole pieces extending in a axial direction medially through said bobbin toward the strings and beyond the base of said bobbin to a noise sensing bobbin-coil assembly as described earlier, the pole pieces being associated with magnetizing means from which magnetic fields are transferred through the pole pieces to the strings.

In this embodiment the pickup has steel side-walls adjacent to the said string sensing pickup coil.

In another embodiment the pole pieces extend through the noise sensing bobbin-coil assembly to a single bar magnet polarized in the axial direction of the pole pieces.

The pickup may further have steel side-walls adjacent to the string sensing pickup coil.

The pole pieces may extend through the core of the noise sensing bobbin-coil assembly with their lower ends exposed beneath the noise sensing bobbin-coil assembly and associated with a pair of opposed bar magnets arranged in the magnetic configuration of a P-90®™ pickup.

The magnetizing means may be a pair of bar magnets extending alongside the opposite sides of the row of pole pieces and disposed beneath the string sensing pickup coil bobbin in original P-90®™ manner. Alternatively the pole pieces may extend through the core of the noise-sensing bobbin to a single bar magnet polarized in the axial direction of the pole pieces.

Alternatively the lower ends of the pole pieces exposed beneath the noise-sensing coil may be associated with a pair of opposed bar magnets arranged in the magnetic configuration of an original P-90®™ pickup.

A plate-steel shield may extend between the bobbins and if desired alongside the opposed side-walls of the upper string-sensing pickup coil in any of the above configurations.

In yet another aspect, this invention resides in a guitar pickup which emulates the desired sonic qualities of a Stratocaster®™ pickup and having an upper string-sensing pickup coil formed about six rod magnets extending through dielectric plates and a noise-sensing bobbin-coil assembly of the present invention disposed beneath the string-sensing pickup coil.

If desired a shield may extend between the string-sensing pickup coil and the noise-sensing coil and further extended as opposed side-walls of the upper string-sensing pickup coil.

Typically the string-sensing pickup coil has between 3,000 and 8,000 turns of 0.050 mm or 0.056 mm copper wire and the lower noise-sensing coil has between 2,000 and 4,000 turns of 0.063 mm or 0.071 mm copper wire. Other wire gauges may be used to achieve desired results. The incorporation of these features in the present invention results in a voltage level gain improvement of between 50% and 80% over earlier successful noise-sensing coils. This improvement allows the noise shield around the string-sensing pickup coil of previous designs to be dispensed with if desired.

In yet a further aspect, this invention resides in a guitar pickup having six spaced parallel rod magnets extending between horizontally opposed coils of which one or both may be formed in accordance with the present invention, the coils being disposed with their axes orthogonal to the rod magnets.

Suitably the coils are wound about similar shape bobbins that may be symmetrical or of the type that taper to one end. Suitably each coil is wound about a bobbin which has a constant width-spacing between opposed sides of the coil where it lies alongside three of the rod magnets and the bobbin tapers therefrom across the remaining three rod magnets.

According to a further aspect of the invention there is provided an improved noise-generating bobbin-coil assembly of the type having a number of conductor turns wound around a magnetically permeable core, for installation upon a guitar in proximity to a stringed instrument pickup and for connection to said pickup output in an out-of-phase configuration in order to cancel externally induced electrical interference in an electrical output from said pickup, the improvement comprising a minimized number of conductor turns wound around a magnetically permeable eddy current reducing core whereby said noise sensing bobbin-coil assembly operatively maintains sensitivity to said interference with minimal electromagnetic interaction with said pickup.

In another aspect this invention resides broadly in a guitar pickup which emulates the desired sonic qualities of a Fender®™ Stratocaster®™ pickup made in the form of a Gibson®™ side-by-side humbucking pickup arrangement, the guitar pickup comprising:

a) a string sensing pickup coil formed about at least one ferrous pole or permanent magnet extending through dielectric plates or a freestanding bobbin, and b) a noise sensing bobbin-coil assembly being as defined above and positioned beside the string sensing pickup coil.

In a further aspect this invention resides broadly in a guitar pickup which emulates the desired sonic qualities of a side-by-side Gibson®™ humbucking pickup, the guitar pickup comprising:

a) a pair of side by side string sensing pickup coils formed about at least one permanent magnet or ferrous pole extending through dielectric plates or freestanding bobbins; and b) a noise sensing bobbin-coil assembly as defined above and positioned below the string sensing pickup coils.

BRIEF DESCRIPTION OF THE DRAWINGS

In order that this invention may be more readily understood and put into practical effect, reference is made to the accompanying drawings, wherein all illustrations are schematic representations and except for FIGS. 7*a* and 7*b*, have side, end and plan views and wherein:

FIG. 7*a* illustrates an alternate form of pickup according to this invention that is a Lace™ design pickup;

FIG. 7*b* illustrates a cross section through the pickup of FIG. 7*a;*

FIG. 8 illustrates a further noise-sensing coil according to this invention having a lamination of rectangular core pins;

DETAILED DESCRIPTION OF THE INVENTION

Figure 1:
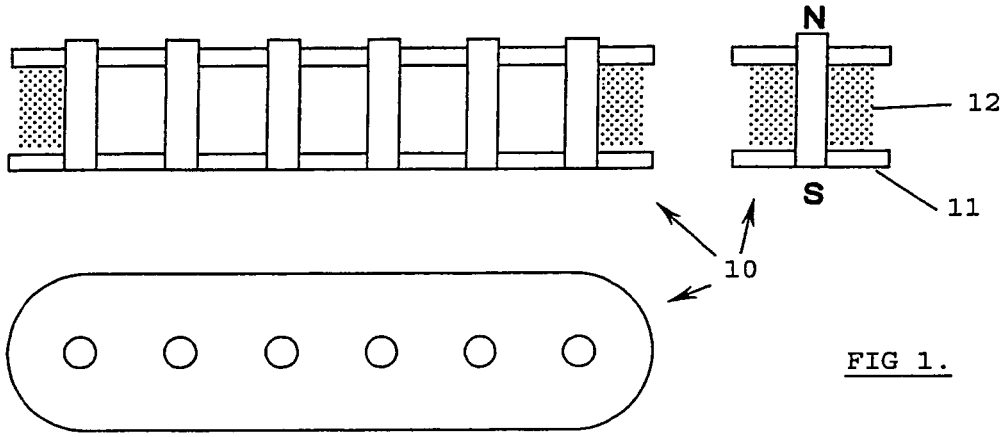
FIG. 1 illustrates a typical Fender®™ Stratocaster®™ single coil pickup configuration.
Figure 1B:
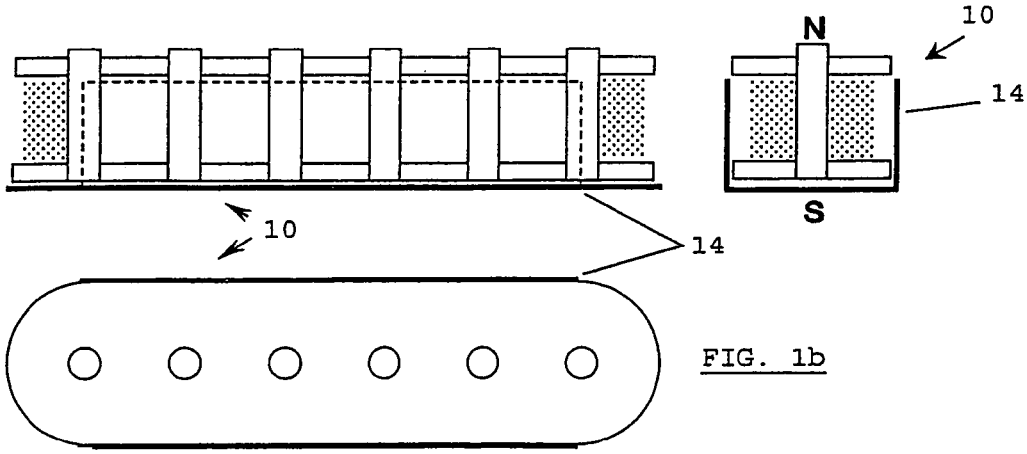
FIG. 1*b* illustrates a typical Jaguar®™ (Fender Musical Instruments, Corp., 7975 North Hayden Road, Scottsdale, Ariz. USA) single coil pickup configuration.

It will be seen from FIGS. 1 and 1*b* that the basic Fender®™ Stratocaster®™ and Jaguar®™ pickups are very simple and provide sonic characteristics known as Fender®™ sound. These characteristics are somewhat subjective but are recognized by guitar players as characteristic attack and dynamic range, point of resonance and output level.

Figure 1C:
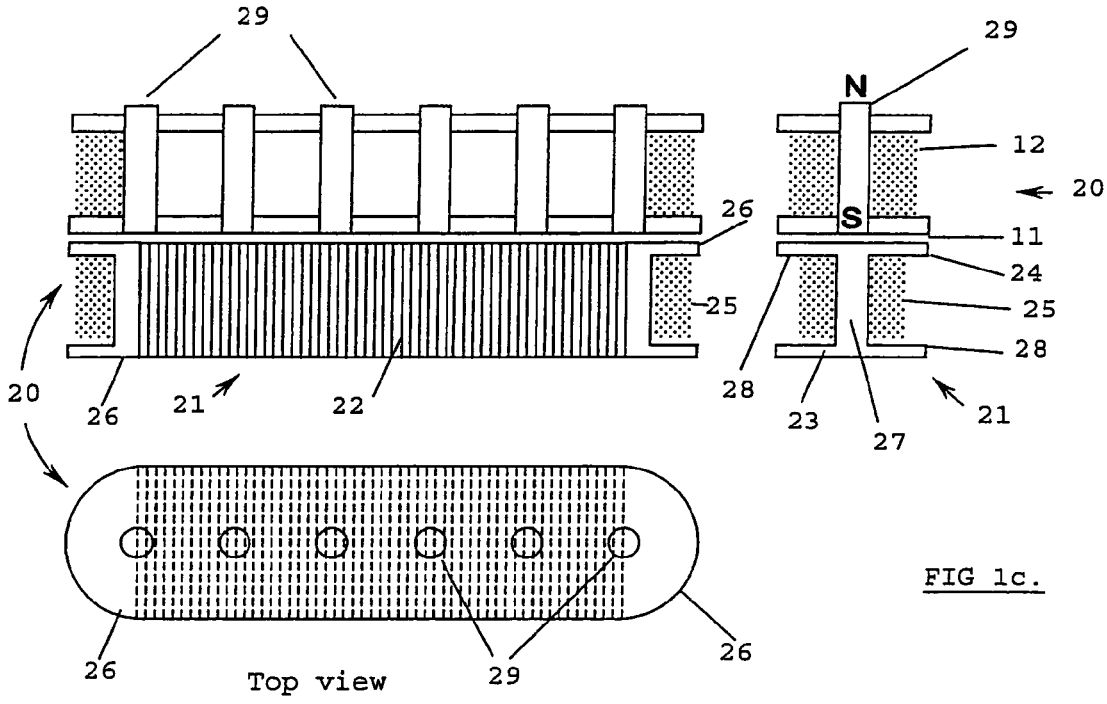
FIG. 1*c* illustrates a single coil pickup of the Stratocaster®™ type with a noise-sensing coil.

The basic Stratocaster®™ pickup 10 illustrated in FIG. 1 is modified in the pickup 20 of the present invention illustrated in FIG. 1*c*, by providing a lower noise-sensing coil assembly 21 attached to the base 11 of the string-sensing signal coil assembly 12. The coils 12 and 21 may be connected in parallel but preferably they are connected in series to achieve the desired tone, so that the noise-voltage of the upper coil may be cancelled by inverting the phase of the lower coil 21 to be at 180 degrees opposed to the upper coil 12. The core 22 of the lower coil is made up of thin H-shaped laminations 23 of specially prepared sheet steel material which are stacked together to form a bobbin 24 in which a wire coil 25 may be wound. The bobbin 24 is completed by half-circle side caps 26 as illustrated. The laminations 23 are electrically insulated from one another suitably by a thin, non-conductive coating applied to the sheet material before the die stamping operation.

The laminated H-section forms the core 27 and integral end plates 28. The string-signal coil in one such embodiment has approximately 5400 turns of 0.056 mm diameter wire and the noise-sensing coil has 2,850 turns of 0.071 mm diameter wire. Six spaced rod magnets 29 are arranged in conventional manner.

Figure 1D:
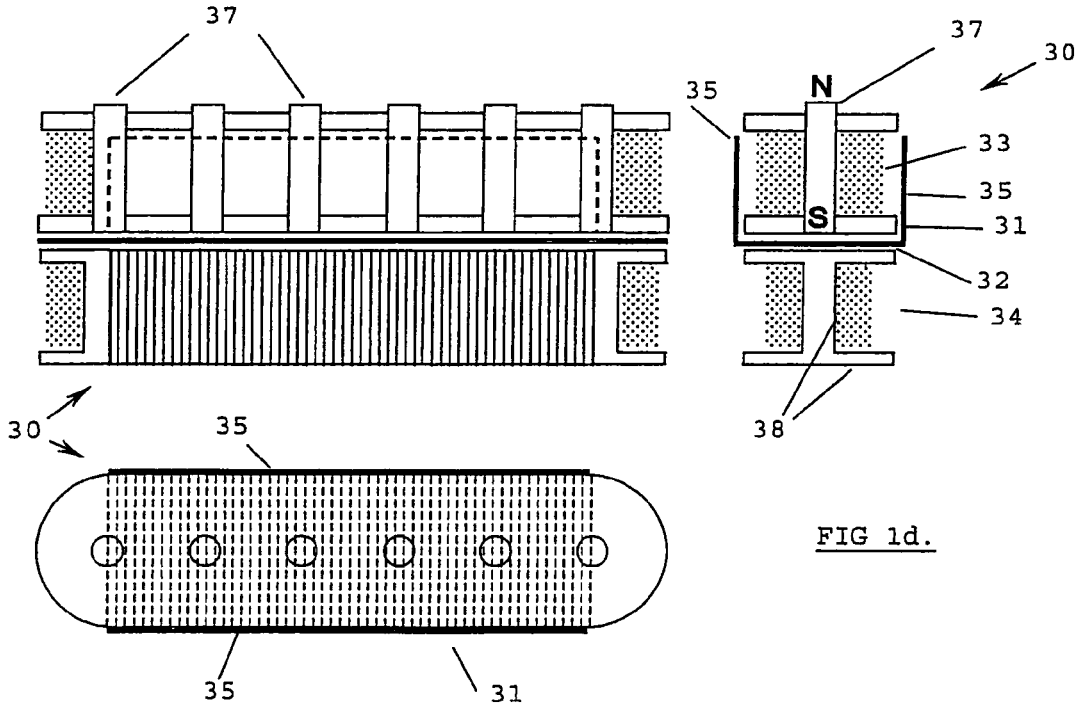
FIG 1*d* illustrates a single coil pickup of the Jaguar®™ type with a noise-sensing coil.

The pickup 30 of the invention illustrated in FIG. 1*d* has a steel shield 31 formed as a U-shaped section arranged with its base 32 between the coils 33 and 34 and its side walls 35 extending alongside the sides of the upper signal coil 33. Six spaced rod magnets 37 are arranged in conventional manner. The shield is similar to the conventional shield 14 used in the Jaguar®™ pickup as illustrated in FIG. 1*b*.

Figure 2:
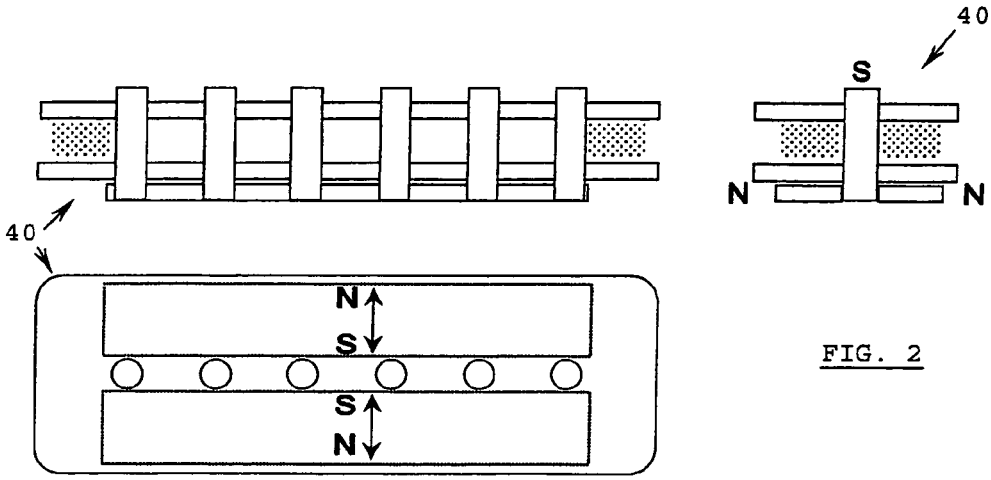
FIG. 2 illustrates a single coil pickup of the Gibson®™ P-90®™ type.
Figure 3:
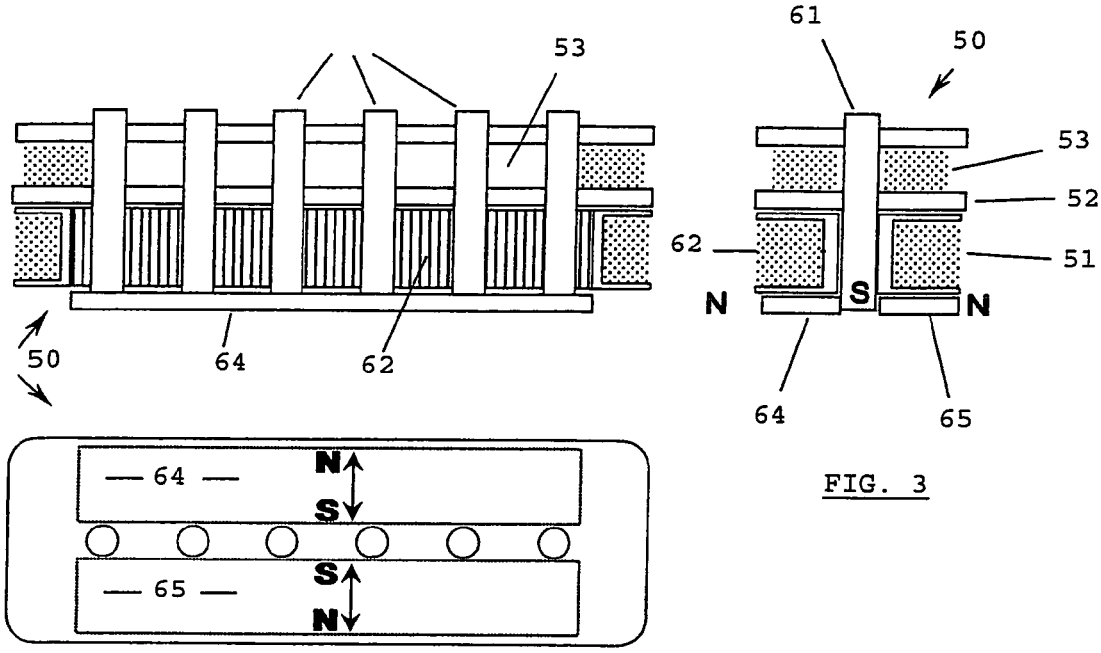
FIG. 3 illustrates a single coil pickup of the Gibson®™ P-90®™ type with a noise-sensing coil formed with a laminated core.

The basic P-90®™ pickup 40 illustrated in FIG. 2 is modified in the pickup 50 of the present invention illustrated in FIG. 3, by providing a lower noise-sensing coil assembly 51 attached to the base 52 of the string sensing signal coil assembly 53. The coils 51 and 53 are connected either in series or parallel so that the noise-voltage of the upper coil may be cancelled by inverting the phase of the lower coil 51 to be at 180 degrees opposed to the upper coil 53.

The steel poles 61 extend through the laminated core 62 of a noise-sensing coil 51 to extend therebeyond between two spaced bar magnets 64 and 65 as illustrated.

Figure 2B:
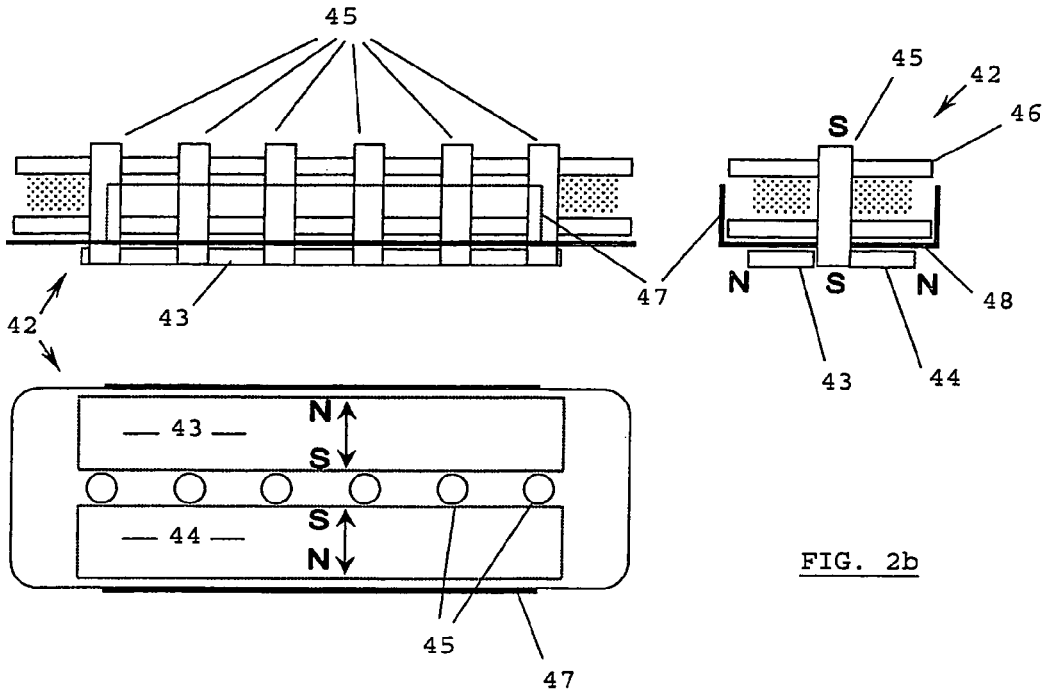
FIG. 2*b* illustrates a single coil pickup of the Gibson®™ P-90®™ type with coil side-walls of steel.

The pickup 40 illustrated in FIG. 2 and the pickup 42 illustrated in FIG. 2*b*, utilize magnetism provided by two bar magnets 43 and 44 located at opposite sides of the downwardly projecting steel poles 45 which are supported in a plastic bobbin 46. The pickup 42 is also provided with a shield 47 in the form of a U-shaped section arranged with its base wall 48 beneath the bobbin 46 and above magnets 43 and 44.

Figure 4:
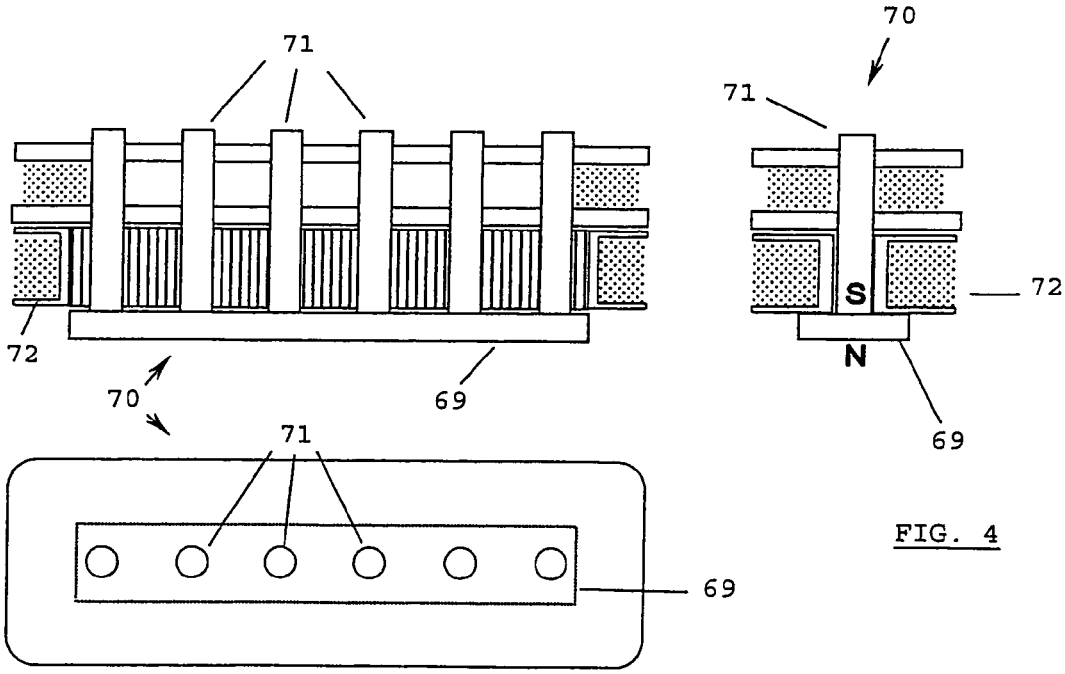
FIG. 4 illustrates a single coil pickup of the Gibson®™ P-90®™ type with a noise-sensing coil formed with a laminated core but utilizing an alternate magnet system.

A variation of the pickup 50 is the pickup 70 illustrated in FIG. 4, the variation being the use of a single bar magnet 69 beneath the steel poles 71 and the base of noise cancelling coil 72.

Figure 5:
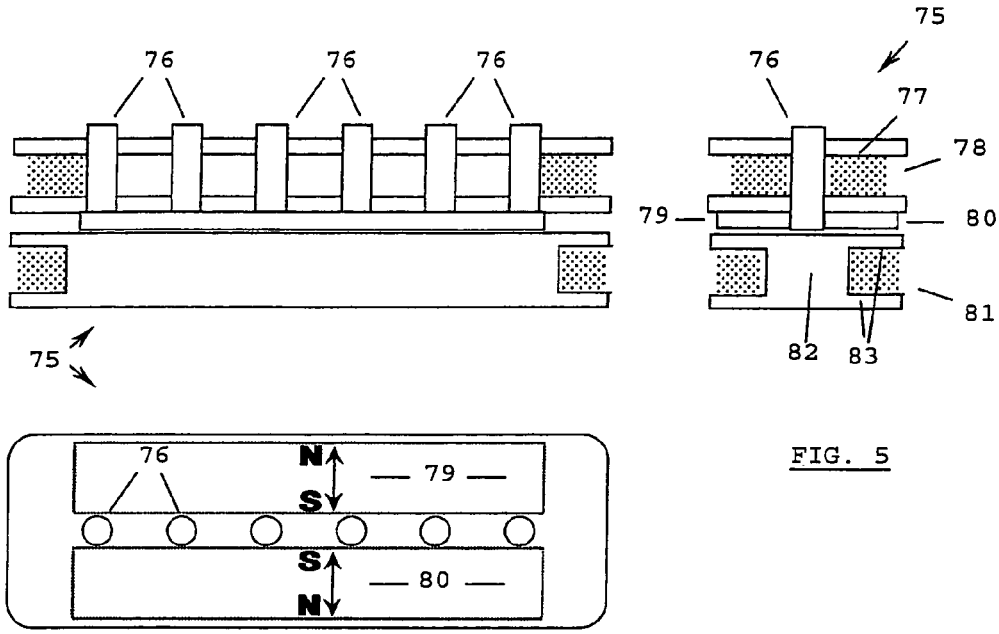
FIG. 5 illustrates a single coil pickup of the Gibson®™ P-90®™ type with a noise-sensing coil formed with a molded ferrite core.
Figure 6:
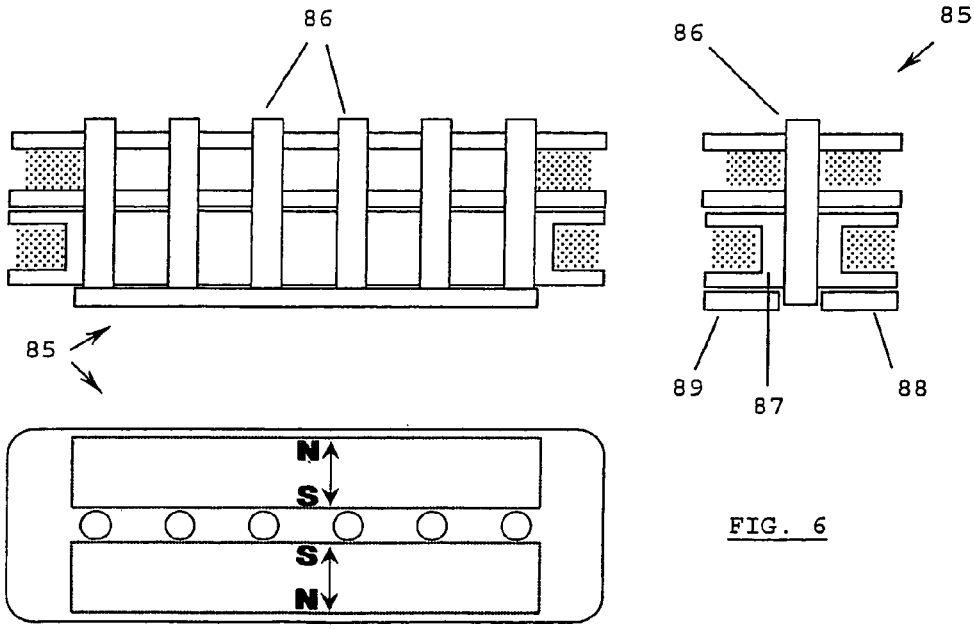
FIG. 6 illustrates a single coil pickup of the Gibson®™ P-90®™ type with a noise-sensing coil formed with a molded ferrite core and an alternate magnet system.

Further variations of these embodiments are illustrated in FIGS. 5 and 6. The pickup 75 illustrated in FIG. 5 has the steel poles 76 extending through the plastic bobbin 77 of the string signal coil 78 and between the bar magnets 79 and 80 but terminating above the noise cancelling coil 81. This coil 81 is formed about a molded ferrite core 82.

The pickup 85 illustrated in FIG. 6 has the steel poles 86 passing through the molded ferrite core 87 to extend between spaced parallel magnets 88 and 89. While not illustrated a single bar magnet could be utilized as in the embodiment illustrated in FIG. 3*c*. and with a corresponding shield if required.

Figure 3B:
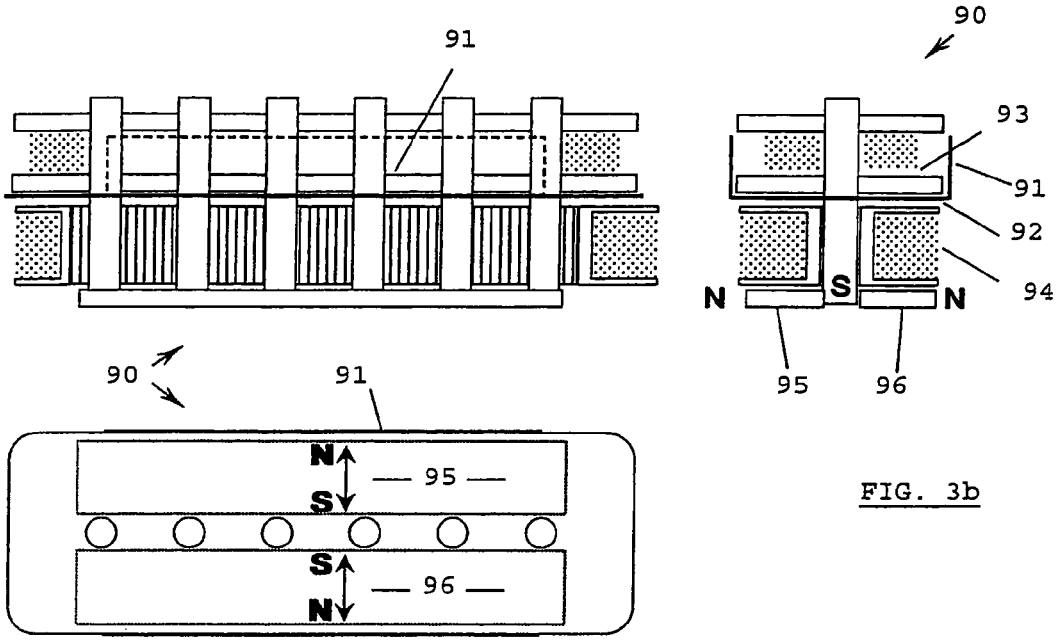
FIG. 3*b* illustrates a single coil pickup of the Gibson®™ P-90®™ type with upper coil side-walls of steel and a noise-sensing coil formed with a laminated core.
Figure 3C:
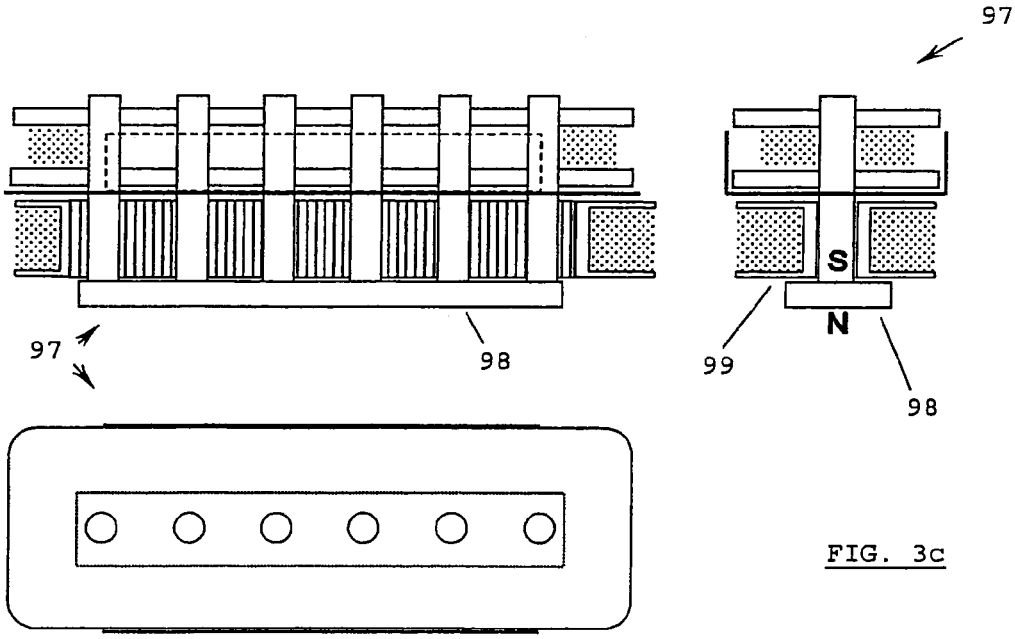
FIG. 3*c* illustrates a single coil pickup of the Gibson®™ P-90®™ type with upper coil side-walls of steel, a noise-sensing coil formed with a laminated core and a different magnet system.

The pickup 75 of FIG. 5 could also be provided with a shield as depicted in FIGS. 3*b* or 3*c*.

The pickup 90 illustrated in FIG. 3*b* has a U-shaped shield 91 arranged with its base 92 between the string signal coil bobbin 93 and the laminated cored noise-sensing coil 94 and steel poles which extend through the bobbin, the base 92 and the noise-sensing coil 94 to terminate between the bar magnets 95 and 96.

The pickup 97 illustrated in FIG. 3*c* is similar to the pickup 90 apart from the use of a single bar magnet 98 against the flush base 99 of the noise-sensing coil and the steel poles.

FIG. 7 illustrates yet another pickup 100 of the Lace™ Sensor type as manufactured by Actodyne General, Inc. (Huntington Beach, Calif. USA) and in which six rod magnets 101 extend between opposed side mounted coils 102 and 103 wound about respective bobbins having a straight base 104 and a top provided with a first portion 105 which extends parallel to the base 104 across three of the magnets 101 then tapers to meet the base adjacent the last rod magnet 101 as illustrated. The opposed coils 102 and 103 are wound about these bobbins which are formed of steel laminations 107 providing end plates 106, or of molded ferrite with integral end plates.

As illustrated in FIG. 8 the laminated core of the noise-sensing coils of this invention may also be formed with square sectioned steel laminations in the form of pins 110 that are insulated from one another. The side pins 111 are suitably round section to assist in the formation of windings about the core but these may also be of the square type.

This arrangement achieves advantages from the laminations in use by minimizing eddy current losses and increasing inductance from the greater surface area of the steel laminations in close proximity to the coil than with conventional round pin designs. Accordingly such a noise-sensing coil should enable fewer turns to be utilized thereby enhancing the quality of the output from the string-sensing coil with which it is used.

Figure 9:
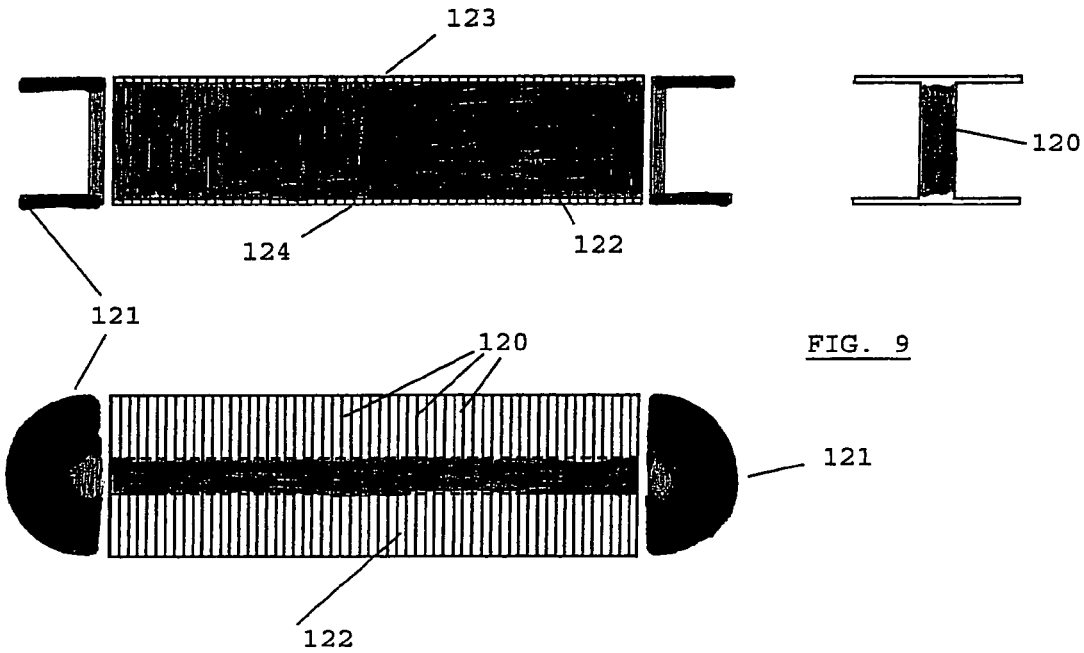
FIG. 9 illustrates a typical configuration of a laminated coil bobbin for a noise-sensing coil according to one aspect of the present invention.

FIG. 9 illustrates the construction of a typical laminated noise sensing coil former (also referred to as a bobbin, a term well known in the art) according to this invention. The former/bobbin is laminated from approximately 120 H-shaped laminations stacked between half-circle flanged side caps 121. Thus, the former, or bobbin, provides a laminated core 122 and laminated end plates 123 and 124.

Figure 10:
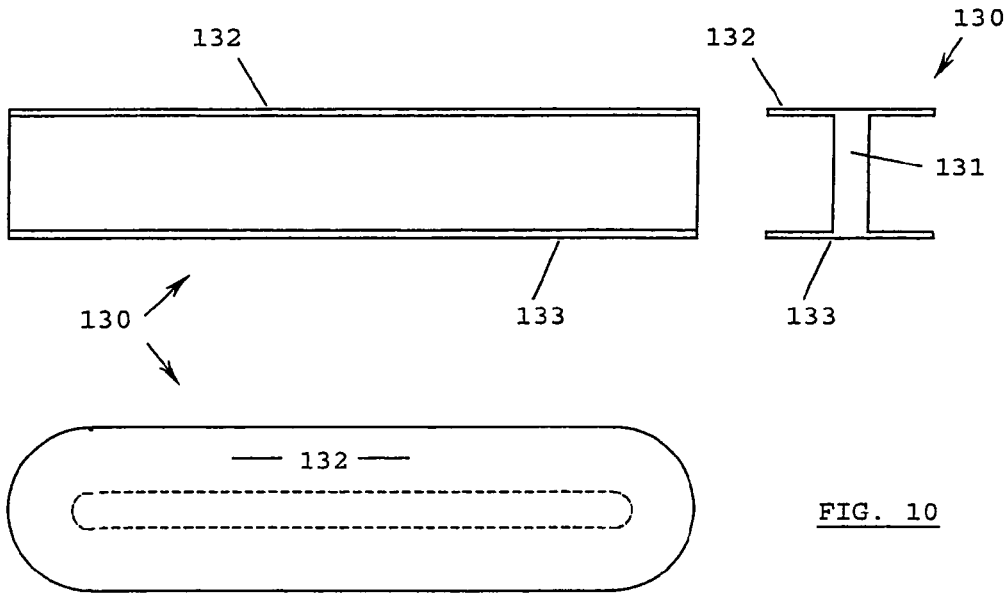
FIG. 10 illustrates a molded ferrite coil bobbin for a noise-sensing coil according to one aspect of the present invention.

FIG. 10 illustrates the construction of a typical molded noise-sensing coil bobbin 130 according to this invention. The bobbin 130 is molded from ferrite material and provides a core 131 and end plates 132 and 133.

Figure 11A:
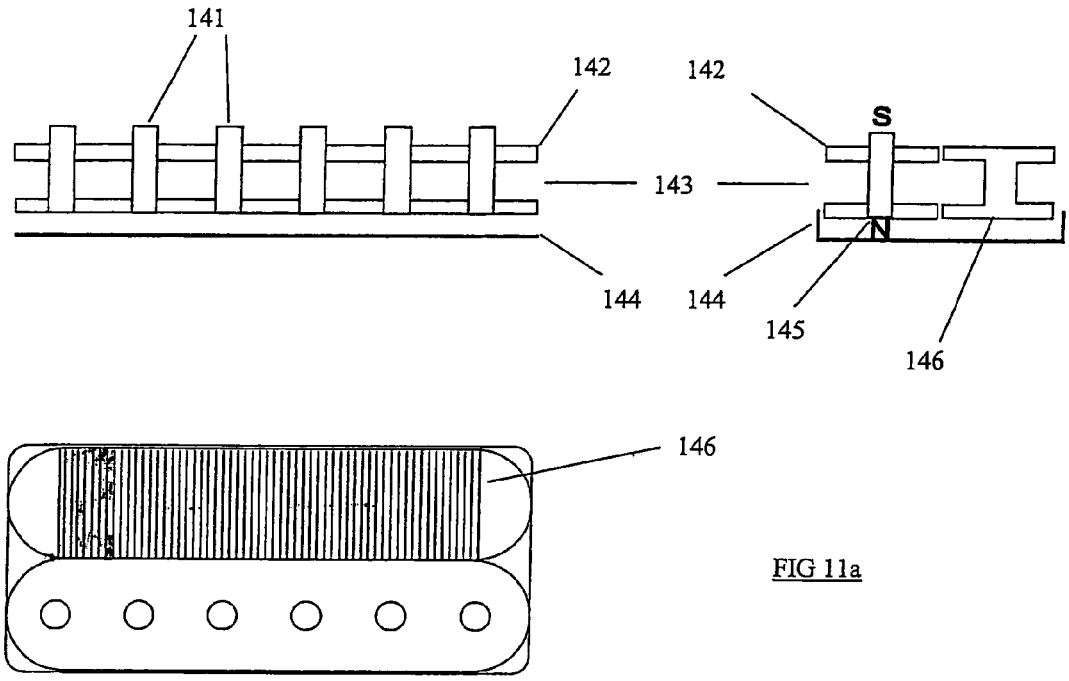
FIG. 11*a* illustrates a novel arrangement of side-by-side string sensing coil and noise sensing coil.

FIG. 11*a* illustrates a novel arrangement of side-by-side string sensing and noise sensing bobbins. As will be appreciated from an understanding of the other embodiments, the pickup arrangement illustrated includes pole pieces 141 in bobbin 142, magnets 145 and base plate 144. Laminated steel bobbin 146 is positioned beside the pickup. Although this layout will produce its own unique sonic signature, noise cancelling is still effective.

Figure 11B:
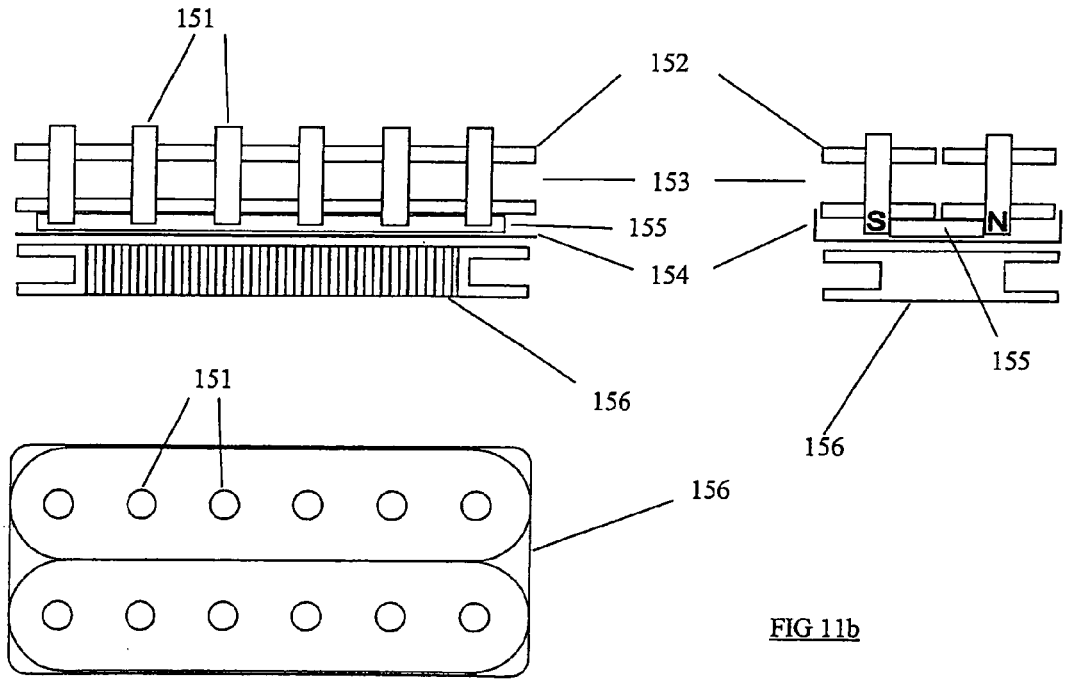
FIG. 11*b* illustrates an arrangement in which the pickup is a conventional Gibson®™ style side-by-side (dual coil) humbucking pickup with the addition of a laminated noise sensing coil in accordance with the present invention.

FIG. 11*b* illustrates an arrangement in which the pickup is a conventional Gibson®™ style dual side-by-side coil humbucking pickup with the addition of a laminated noise sensing coil in the type of the present invention to cancel noise when the pickup has either of its coils disabled to produce single coil sound. Similarly as described above, the side by side humbucking pickup has pole pieces 151 in bobbins 152, bar magnet 155 and base plate 154. Laminated steel bobbin 156 is positioned beneath the pickup.

It will be seen from the above that noise-sensing coils of the present invention achieve the required high level of inductivity for noise cancelling and low sonic degradation when applied to the above-mentioned pickups.

The noise-sensing bobbin of the present invention achieve a very high density (mass) of magnetic material in the core while minimizing eddy current losses in the core and/or end plates.

The previous limitations of unitary-component coil end-plates and cores to increase inductivity has been the countering effect of eddy currents set up within the plate or core itself. These Eddy currents effectively reduce inductivity. The very high inductance achieved with this design results in a dramatic increase in the value of noise voltage thus achievable. Gains of over 60% in efficiency are common with it. The improved noise-voltage/turns ratio allows a lower coil turns-count to be used which consequently imposes less constricting effect on the sonic qualities of the pickup coil due to lower capacitance. Thus, the tonal and response characteristics of single coil pickups may be preserved together with effective noise cancellation.

This invention has been described in terms of specific embodiments, set forth in detail. It should be understood, however, that these embodiments are presented by way of illustration only, and that the invention is not necessarily limited thereto. Modifications and variations within the spirit and scope of the claims that follow will be readily apparent from this disclosure, as those skilled in the art will appreciate.

I claim:

1. A noise sensing assembly for use with a stringed musical instrument pickup, the noise sensing assembly comprising:

at least one noise-sensing coil for electrically coupling with string sensing coil, the noise-sensing coil comprising a core, the core comprising a ferrite material whereby eddy current losses are reduced when a voltage is induced in the noise-sensing coil in order to cancel a noise voltage induced in the string-sensing coil.

2. The noise sensing assembly of claim 1, wherein the ferrite material is a composite ferrite material.

3. The noise sensing assembly of claim 1, wherein the core of the noise-sensing coil further comprises:

at least one end plate extending transversely of at least one end of the core; and a coil of copper wire wound on the core.

4. The noise sensing assembly of claim 2, wherein the at least one end plate comprises two end plates extending transversely of opposite ends of the core.

5. The noise sensing assembly of claim 4, wherein the core and end plates of the noise-sensing coil are integrally formed from composite ferrite material.

6. A noise sensing assembly for use with a stringed musical instrument pickup, the noise sensing assembly comprising:

at least one noise-sensing coil for electrically coupling with a string sensing coil, the noise-sensing coil comprising a core, the core comprising steel laminations whereby eddy current losses are reduced when a voltage is induced in the noise-sensing coil in order to cancel a noise voltage induced in the string-sensing coil.

7. The noise sensing assembly of claim 6, wherein the noise-sensing coil further comprises:

at least one end plate extending transversely of at least one end of the core; and a coil of copper wire wound on the core.

8. The noise sensing assembly of claim 7, wherein to at least one end plate comprises two end plates extending transversely of opposite ends of the core.

9. The noise sensing assembly of claim 6, wherein the steel laminations are electrically insulated from one another.

10. The noise sensing assembly of claim 6, wherein the steel laminations constitute core pins of substantially rectangular cross-section.

11. The noise sensing assembly of claim 10, wherein the core pins are substantially square in cross-section and are interposed between outer core pins which are of substantially circular crass-section.

12. The noise sensing assembly of claim 6, further comprising a string-sensing coil and steel side-walls adjacent to the coil.

13. The noise sensing assembly of claim 12, wherein the string-sensing coil has between 3,000 and 8,000 turns of 0.050 mm or 0.056 mm wire, end wherein the noise-sensing coil has between 1,000 and 4,000 turns of 0.063mm or 0.071 mm wire.

14. The noise sensing assembly of claim 12, wherein the noise-sensing coil is positioned adjacent the string-sensing coil.

15. The noise sensing assembly of claim 6, further comprising a string-sensing coil, wherein the string-sensing coil further comprises a core, and wherein the care of the noise-sensing coil and the core of the string-sensing coil each are connected to two end plates extending transversely of each end of each core to form a bobbin or former for each coil.

16. The noise sensing assembly of claim 15, wherein each coil further comprises copper wire wound on the bobbin or former.

17. The noise sensing assembly of claim 16, wherein the bobbin or former of the string-sensing coil further comprises a plurality of steel pole pieces extending in use in an axial direction through the core toward the instrument strings and away from the bobbin or former through the noise-sensing coil;

and the stringed musical instrument pickup further comprises a magnetizing means, the steel pole pieces transferring magnetic fields therefrom to the instrument strings.

18. The noise sensing assembly of claim 17, further comprising steel side-walls adjacent to the string-sensing coil.

19. The noise sensing assembly of claim 17, wherein the pole pieces extend through to stringed musical instrument pickup to a single bar magnet.

20. The noise sensing assembly of claim 17, wherein the pole pieces extend through the core of the string-sensing coil and wherein the magnetizing means is a pair of transversely spaced bar magnets.

21. The noise sensing assembly of claim 17, wherein the noise-sensing coil is positioned below the string-sensing coil.

22. The noise sensing assembly of claim 6 further comprising:

at least one string-sensing coil; and a U-shaped shield encompassing a portion of the string-sensing coil.

23. The noise sensing assembly of claim 22 wherein the U-shaped shield is a separate component from the core.

24. The noise sensing assembly of claim 22 wherein the U-shaped shield includes two sidewalls and a base, the sidewalls and base being integral.

25. The noise sensing assembly of claim 6 wherein the steel laminations are at least partially H-shaped, the bridges of each H forming the core and a leg of the H forming an endplate.

26. The noise sensing assembly of claim 1 further comprising:

at least one string-sensing coil; and a U-shaped shield encompassing a portion of the one string-sensing coil.

27. The noise sensing assembly of claim 26 wherein the U-shaped shield is a separate component from the core.

28. The noise sensing assembly of claim 26 wherein the U-shaped shield includes two sidewalls and a base, the sidewalls and base being integral.

* * * * *